US006814039B2

(12) United States Patent
Kreuter et al.

(10) Patent No.: US 6,814,039 B2
(45) Date of Patent: Nov. 9, 2004

(54) VALVE-ACTUATING DEVICES FOR INTERNAL COMBUSTION ENGINES HAVING CHANGEABLE STROKE FUNCTIONS

(75) Inventors: Peter Kreuter, Aachen (DE); Joachim Reinicke-Murmann, Aachen (DE); Rüdiger Erz, Baesweller (DE); Marcel Franssen, Alsdorf (DE)

(73) Assignee: Meta Motoren-Und Energie-Technik GmbH, Herzogenrath (DE)

( * ) Notice: Subject to any disclaimer, the term of this patent is extended or adjusted under 35 U.S.C. 154(b) by 0 days.

(21) Appl. No.: 10/796,989

(22) Filed: Mar. 11, 2004

(65) Prior Publication Data

US 2004/0177820 A1 Sep. 16, 2004

(30) Foreign Application Priority Data

Mar. 13, 2003 (DE) ..... 103 11 069

(51) Int. Cl.[7] ..... F01L 1/18

(52) U.S. Cl. ..... 123/90.39; 123/90.16; 123/90.45; 123/90.46

(58) Field of Search ..... 123/90.16, 90.17, 123/90.39, 90.45, 90.46, 90.6; 29/888.2; 74/559

(56) References Cited

U.S. PATENT DOCUMENTS 4,793,307 A * 12/1988 Quenneville et al. ..... 123/323
5,692,465 A 12/1997 Sawada et al.
5,794,576 A * 8/1998 Hara et al. ..... 123/90.16
5,908,015 A 6/1999 Kreuter
6,009,861 A 1/2000 Kreuter
6,131,545 A 10/2000 Kreuter
6,186,101 B1 2/2001 Kreuter
6,467,443 B1 * 10/2002 Tsuruta et al. ..... 123/90.16
2002/0124820 A1 9/2002 Kreuter
2003/0209216 A1 11/2003 Kreuter
2004/0003789 A1 1/2004 Kreuter

* cited by examiner

*Primary Examiner*—Thomas Denion
*Assistant Examiner*—Ching Chang
(74) *Attorney, Agent, or Firm*—Birch, Stewart, Kolasch, & Birch, LLP.

(57) ABSTRACT

Valve actuating devices may include a pivot lever (8) having an abutment element (21) displaced from a bearing pin (6). The pivot lever is pivotable by a reciprocating push rod (54). An intermediate lever (26) is pivotably disposed on the pivot lever. A valve lever (40) is pivotably disposed in the intermediate lever and has an abutment surface (44) for contacting the abutment element. A locking device (14, 16) is capable of fixedly coupling the intermediate lever to one of the pivot lever or the valve lever. When the intermediate lever is fixedly coupled to the pivot lever or the valve lever, the valve is actuated according to a first valve stroke function. When the intermediate lever is pivotable relative to the pivot lever and the valve lever, the valve is actuated according to a second valve stroke function.

16 Claims, 3 Drawing Sheets

VALVE-ACTUATING DEVICES FOR INTERNAL COMBUSTION ENGINES HAVING CHANGEABLE STROKE FUNCTIONS

CROSS-REFERENCE

This application claims priority to German patent application no. 103 11 069.0 filed Mar. 13, 2003, the contents of which are incorporated by reference as if fully set forth herein.

1. Technical Field

The invention relates to devices that are capable of a plurality of stroke functions for actuating a charge-changing valve of an internal combustion engine.

2. The Related Art

Variable stroke functions of the charge changing valve, particularly of the intake valve, of an internal combustion engine, offer numerous advantages concerning consumption, exhaust gas quality, the torque and power performance, and so on. One known device is described in U.S. Pat. No. 5,692,465, which capable of actuating a valve according to high-speed stroke function and a low-speed stroke function, in which an overhead camshaft has first cam and a second, smaller cam for changing the stroke function.

Other devices capable of changing the valve opening characteristics of a valve are taught by commonly-owned U.S. Patent Publication Nos. 2003-209216 and 2004-3789.

SUMMARY OF THE INVENTION

The present teachings are concerned with the problem of creating an apparatus capable of varying or changing the stroke function of a charge changing valve of a piston internal combustion engine during operation. Such an apparatus is particularly suited for internal combustion engines having valves that are actuated via push rods driven by a rotating camshaft situated close to the crank shaft or directly by the crankshaft.

In one aspect of the present teachings, valve actuating devices are taught that are capable of switching between a first stroke function and a second stroke function. The first and second functions may have substantially similar valve opening and closing profiles, but the timing of the valve opening and valve opening distance are different. For example, the first valve opening function may initiate the valve opening operation earlier than the second opening function, while also closing the valve later than the second opening function. In addition, the peak (maximum) valve opening distance of the first stroke function is greater than the peak (maximum) valve opening distance of the second stroke function.

Apparatus according to the present teachings, which are described in further detail below, can be compactly assembled and can be utilized without significant modifications, e.g., in a variety of engines that have push rod actuated valves.

Additional objects, features and advantages of the present teachings will be readily understood to a person of ordinary skill in the art after reading the following detailed description of examples and embodiments of the present teachings together with the claims and the accompanying drawings.

DETAILED DESCRIPTION OF THE INVENTION

Figure 1:
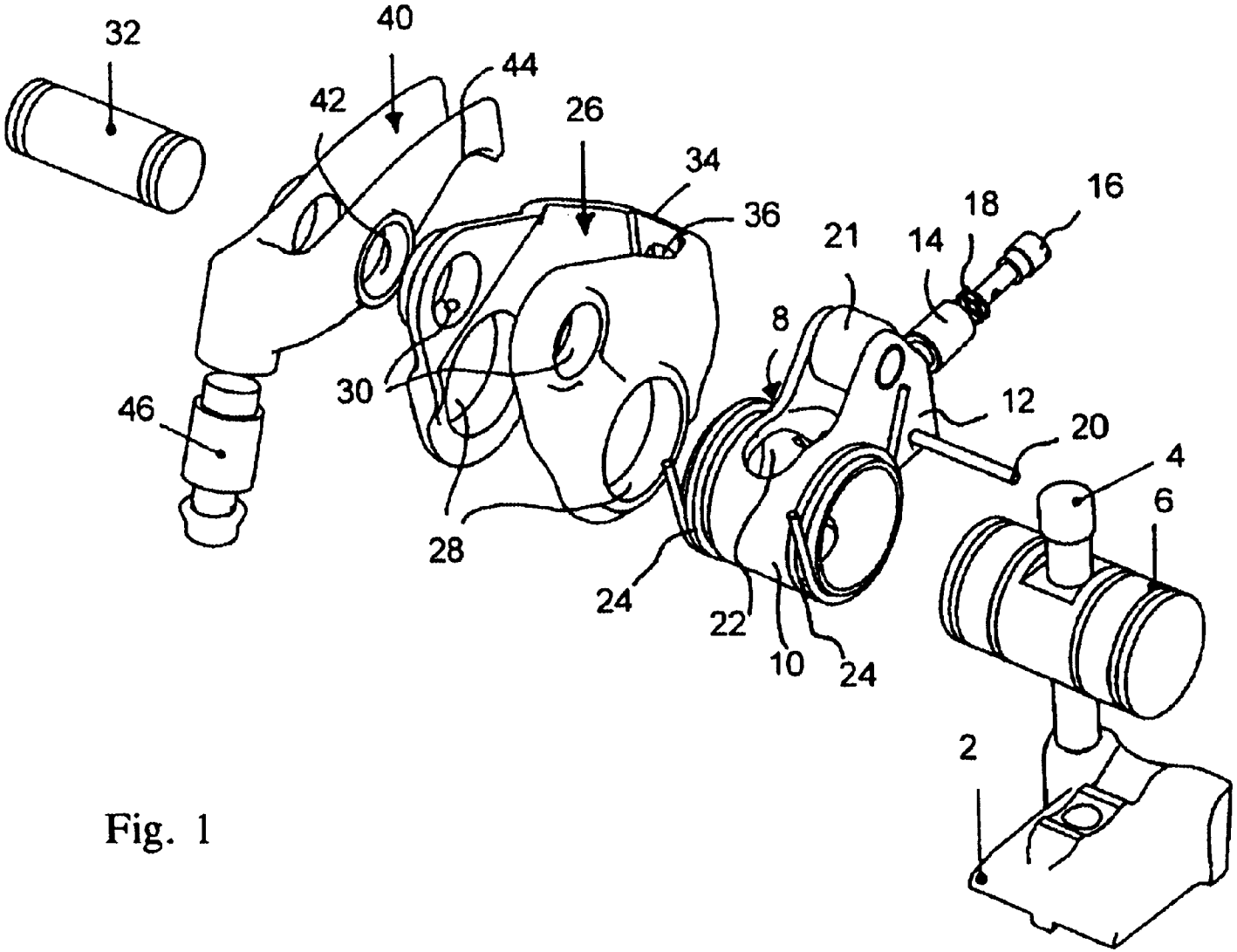
FIG. 1 is a perspective, exploded view of components of a representative embodiment of the present teachings.

In one embodiment of the present teachings, apparatus are taught that are capable of actuating a valve of an internal combustion engine according to a first stroke function and a second stroke function, which is different from the first stroke function. For example, a pivot lever may be mounted so as to be pivotable about an axis that is stationary relative to the engine. The pivot lever preferably has an abutment element displaced from the axis and the pivot lever is arranged and constructed to be pivoted about the axis by a reciprocating actuating device (e.g., a push rod) that is moved by a rotating element of the engine, such as a camshaft or a crankshaft. An intermediate lever may be pivotably disposed on the pivot lever.

A valve lever may be pivotably disposed with respect the intermediate lever so as to reciprocally move the valve according to the first stroke function or the second stroke function. The valve lever preferably comprises an abutment surface arranged and constructed to abut the abutment element. A locking device may be actuated so as to (selectively) fixedly couple the intermediate lever to one of the pivot lever or the valve lever.

Preferably, when the locking device is selectively actuated to fixedly couple the intermediate lever to one of the pivot lever and the valve lever, pivotal movement of the pivot lever is transferred to the valve lever without the pivot lever pivoting relative to the valve lever. As a result, the valve is actuated according to the first stroke function. Further, when the locking device is actuated to decouple (unlock) the intermediate lever from one of the pivot lever and the valve lever, pivotal movement of the pivot lever is transferred to the valve lever by a combination of the pivot lever pivoting relative to the valve lever and the abutment element moving along the abutment surface. As a result, the valve is actuated according to the second stroke function. In one aspect of the present teachings, the second stroke function lies within the first stroke function. In an optional embodiment, the second stroke function may define a valve opening distance and a valve opening duration that are less than a valve opening distance and a valve opening duration of the first stroke function.

According to another embodiment of the present teachings, the locking mechanism may comprise a locking element that selectively engages the intermediate lever so as to fixedly couple the pivot lever with the intermediate lever and selectively disengages from the intermediate lever so as to permit the pivot lever to pivot relative to the intermediate lever. Further, the intermediate lever may be generally U-shaped with a pair of parallel arms connected by a crosspiece. A locking hole may be defined within the crosspiece and the pivot lever may be accommodated within the parallel arms. The locking element may include a projection that selectively engages the locking hole in order to fixedly couple the pivot lever with the intermediate lever. In addition, a spring may be disposed between the pivot lever and the intermediate lever, which spring biases the pivot lever, relative to the intermediate lever, towards the reciprocating actuation member. Optionally, the valve lever may be disposed between the parallel arms of the intermediate lever and may be supported via a hydraulic valve play-compensating element on a valve stem of the valve.

In another embodiment, the abutment element may comprise a roller that rolls or slides along the abutment surface of the valve lever when the pivot lever is pivotable (unlocked) with respect to the intermediate lever.

In another embodiment, the locking device may comprise a piston, which is movable into a hydraulic cylinder disposed in the pivot lever. Further, the hydraulic cylinder may be pressurized with different hydraulic pressures so as to lock and unlock the pivoting movement of the intermediate lever. Optionally, hydraulic fluid supply ducts may supply lubrication to bearing surfaces and to the hydraulic valve play-compensating element In another embodiment, the reciprocating actuating element comprises a push rod that is linearly movable by contacting a rotating camshaft or crankshaft of the engine. Optionally, the push rod may comprise a hydraulic fluid supply duct. Moreover, a bearing pin optionally may define the axis that is stationary relative to the pivot lever. In this case, the bearing pin may extend through and support the pivot lever. Further, the intermediate lever may be supported on the outside of the pivot lever.

In another embodiment, methods for actuating a valve of an internal combustion engine are taught. The valve preferably controls the flow of a fluid into and out of a combustion cylinder. According to a representative method, an intermediate lever of a valve actuating device may be selectively locked (fixedly coupled) to one of a pivot lever and a valve lever of the valve actuating device. Then, the pivot lever, the intermediate lever and the valve lever may be reciprocally pivoted about a pivotal axis. In this case, pivotal movement of the pivot lever is transferred to the valve lever without the pivot lever pivoting relative to the valve lever. As a result, the valve is actuated according to a first stroke function.

Thereafter, the intermediate lever may be selectively released from said one of the pivot lever and the valve lever and the pivot lever, the intermediate lever and the valve lever may be reciprocally pivoted about the pivotal axis. In this case, pivotal movement of the pivot lever is transferred to the valve lever by a combination of the pivot lever pivoting relative to the valve lever and an abutment element of the pivot lever moving (e.g., sliding) along an abutment surface of the valve lever. As a result, the valve is actuated according to a second stroke function. In a preferred embodiment, the second stroke function has a shorter valve opening duration than the first stroke function and the second stroke function has a smaller valve opening distance that the first stroke function.

In another embodiment, additional apparatus for actuating a valve of an internal combustion engine are taught. Again, the valve preferably controls the flow of a fluid into and out of a combustion cylinder. Further, the apparatus preferably includes an intermediate lever, a pivot lever and a valve lever.

Means (e.g., a piston/aperture arrangement) may be provided for selectively locking (fixedly coupling) the intermediate lever to one of the pivot lever and the valve lever. When the intermediate lever is locked (fixedly coupled) to said one of the pivot lever and the valve lever, pivotal movement of the pivot lever is transferred to the valve lever without the pivot lever pivoting relative to the valve lever. As a result, the valve is actuatable according to a first stroke function. When the intermediate lever is unlocked (decoupled) from said one of the pivot lever and the valve lever, pivotal movement of the pivot lever is transferred to the valve lever by a combination of the pivot lever pivoting relative to the valve lever and an abutment element of the pivot lever moving along an abutment surface of the valve lever. As a result, the valve is actuatable according to a second stroke function.

In addition, means (e.g., a reciprocating push rod) may be provided for reciprocally pivoting the pivot lever, the intermediate lever and the valve lever about a pivotal axis. In a preferred embodiment, the second stroke function has a shorter valve opening duration than the first stroke function and the second stroke function has a smaller valve opening distance that the first stroke function.

Each of the additional features and teachings disclosed below may be utilized separately or in conjunction with other features and teachings to provide improved valve actuating devices and methods for designing and using the same. Representative examples of the present invention, which examples utilize many of these additional features and teachings both separately and in combination, will now be described in further detail with reference to the attached drawings. This detailed description is merely intended to teach a person of skill in the art further details for practicing preferred aspects of the present teachings and is not intended to limit the scope of the invention. Therefore, combinations of features and steps disclosed in the following detail description may not be necessary to practice the invention in the broadest sense, and are instead taught merely to particularly describe representative examples of the present teachings.

Moreover, the various features of the representative examples and the dependent claims may be combined in ways that are not specifically and explicitly enumerated in order to provide additional useful embodiments of the present teachings. In addition, it is expressly noted that all features disclosed in the description and/or the claims are intended to be disclosed separately and independently from each other for the purpose of original disclosure, as well as for the purpose of restricting the claimed subject matter independent of the compositions of the features in the embodiments and/or the claims. It is also expressly noted that all value ranges or indications of groups of entities disclose every possible intermediate value or intermediate entity for the purpose of original disclosure, as well as for the purpose of restricting the claimed subject matter.

Referring to FIG. 1, a bearing pin 6 is rigidly attached to a mounting base 2 via a bolt 4. The mounting base 2 is arranged and constructed to be fixedly mounted on a stationary component within an engine compartment, such as the engine block or the engine housing.

A pivot lever 8 is pivotably mounted on the bearing pin 6. The pivot lever 8 includes a cylindrical-shaped bearing portion 10 and a projection 12. A locking device is partially disposed within the projection 12.

The locking device includes a stepped blind hole, which is not visible in FIG. 1, defined in the projection 12. A piston 14 is inserted into a larger diameter outer portion of the blind hole. A spring-holding pin 16 is inserted into the piston 14 and is also formed with a step. A spring 18 is disposed between the spring-holding pin 16 and the piston 14. When the piston 14 is pushed into the projection 12, the spring-holding pin 16, which penetrates through the piston 14, is held by a holding pin 20 that extends transversely through the projection 12 and through a transverse (lateral) hole defined in the spring-holding pin 16.

Lugs formed on the top side of the projection 12 retain an abutment element 21, which may be formed, e.g., as a roller or a cylinder. In addition, a through opening (aperture) 22 extends vertically through the pivot lever 8, as shown in FIG. 1. A leg spring 24 is disposed on each end portion of the bearing portion 10. The leg spring 24 is preferably a coil or torsion spring, although other spring arrangements can be utilized in accordance with the present teachings, as will be understood from the following description.

A generally U-shaped intermediate lever 26 includes two arms, each having a bearing opening 28 defined therein. The bearing pin 6 is disposed within the bearing openings 28 of the intermediate lever 26. As shown in FIG. 1, projections extend upwardly and diagonally from each of the arms of the intermediate lever 26. An aperture 30 is defined within each projection and a bearing pin 32 is disposed within the apertures 30.

A crosspiece 34 connects the arms of the intermediate lever 26 and a locking hole 36 is defined in the crosspiece 34. An outer portion of the piston 14 can be moved (inserted) into the locking hole 36 when actuated, for example by applying pressure, e.g. hydraulic pressure, to the inner end face of the piston 14. In other words, when the piston 14 is outwardly moved, the outer end of the piston 14 can be inserted into (engage with) the locking hole 36, as will be further discussed below. If hydraulic pressure is utilized to reciprocally move the piston 14, the hydraulic pressure can be communicated via a (not shown) bore hole defined in projection 12.

Bearing holes 42 are defined in a valve lever 40. The bearing pin 32 extends through the bearing holes 42 so as to pivotably support the valve lever 40. In the representative embodiment, the valve lever 40 includes a concavely curved abutment surface 44 adapted to abut or contact the abutment element 21. The abutment surface 44 is set apart (displaced) from the bearing hole 42. On the opposite side of the abutment surface 44, the valve lever 40 also preferably includes a surface adapted to abut or contact a hydraulic play-compensating element 46.

A representative method for assembling the components shown in FIG. 1 will now be described. The piston 14, the spring 18 and the spring-holding pin 16 are assembled in the projection 12 of the pivoting lever 8 and are secured with the holding pin 20. The leg springs 24 are pushed onto the respective bearing portions 10. The abutment element 21 is set into the designated recesses between the arms of the pivot lever 8. The intermediate lever 26 is assembled with the pivoting lever 8, as stated above, in such a manner that the pivot lever 8 is positioned within the intermediate lever 26. Further, the bearing openings 28 are aligned with the through openings (not numbered) defined in the bearing portion 10.

Figure 4:
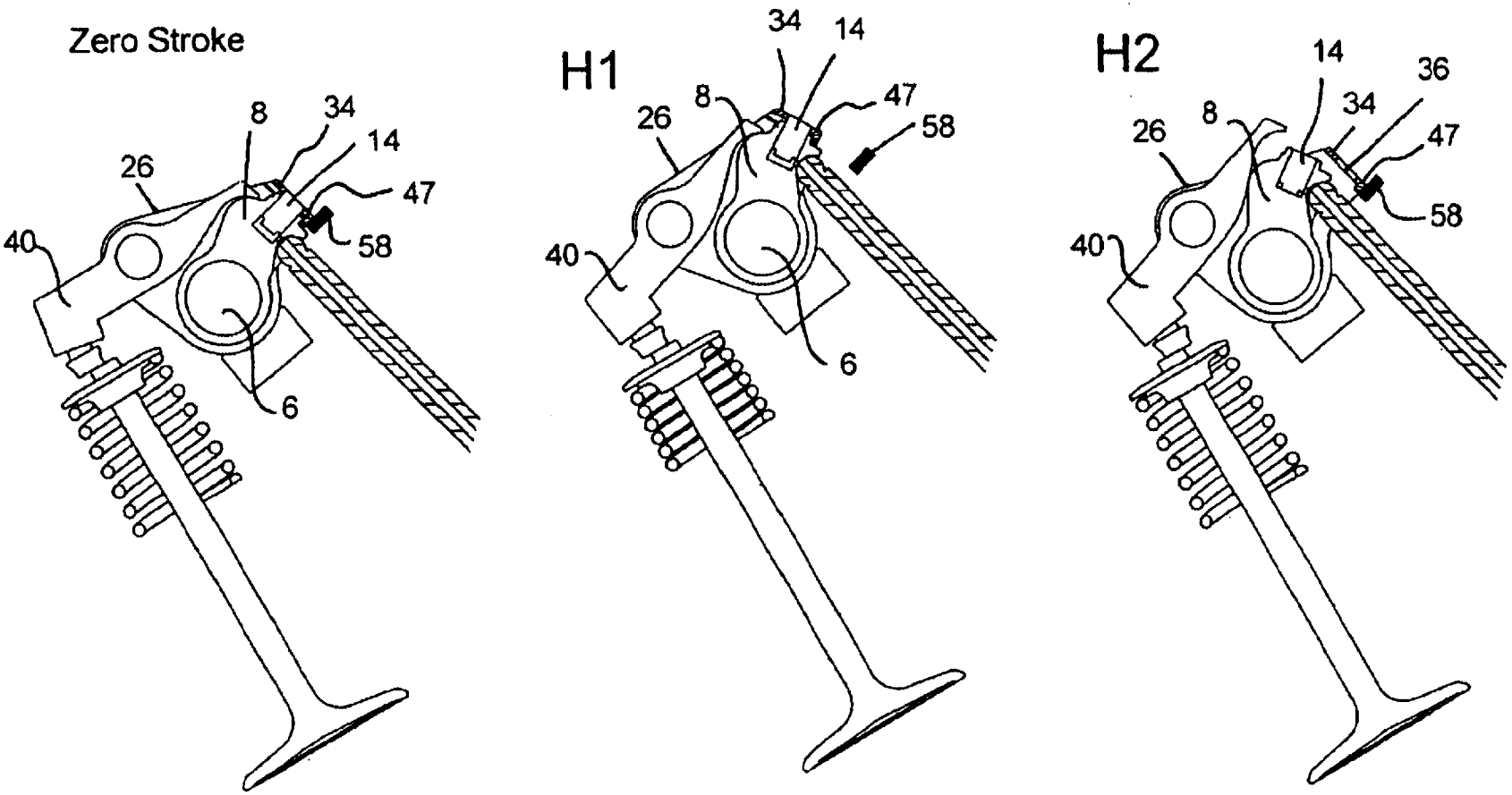
FIG. 4 shows the representative embodiment of FIGS. 1 and 2 in three different operating positions.

The bearing pin 6 is inserted through the two levers 8, 26, so that pin 6 holds (or supports) the pivot lever 8 in a coaxial relationship with respect the intermediate lever 26. A first leg (terminal end) of each leg spring 24 is supported by the respective ends of the holding pin 20 that transversely (perpendicularly) protrude from the projection 12. A second leg (terminal end) of each leg spring 24 is supported by respective inner surfaces defined on the arms of the intermediate lever 26. The leg springs 24 serve to bias or urge the pivot lever 8 in a clockwise direction relative to the intermediate lever 26. As shown in FIG. 4, the pivot lever 8 also abuts a stop 47 defined on the intermediate lever 26. The stop 47 is preferably defined on the lower side of the crosspiece 34.

Thereafter, the bolt 4 is inserted through the opening 22 and the bearing pin 6 and then is screwed into the mounting base 2. As a result, the bearing pin 6 is rigidly fixed in position relative to the mounting base 2. As noted above, the mounting base 2 is preferably arranged and constructed to be fixedly attached to a stationary element within the engine compartment, such as the engine housing or the engine block.

The valve lever 40 is then mounted on the intermediate lever 26 via the bearing pin 32. The hydraulic valve play-compensating element 46 is positioned between the valve stem 48 of a valve 50, which valve 50 will be actuated (reciprocally opened and closed) by the valve lever 40, and a portion of the valve lever 40. The valve 50 is biased towards a valve closed position by a closing spring 52, as is well known in the art.

Figure 2:
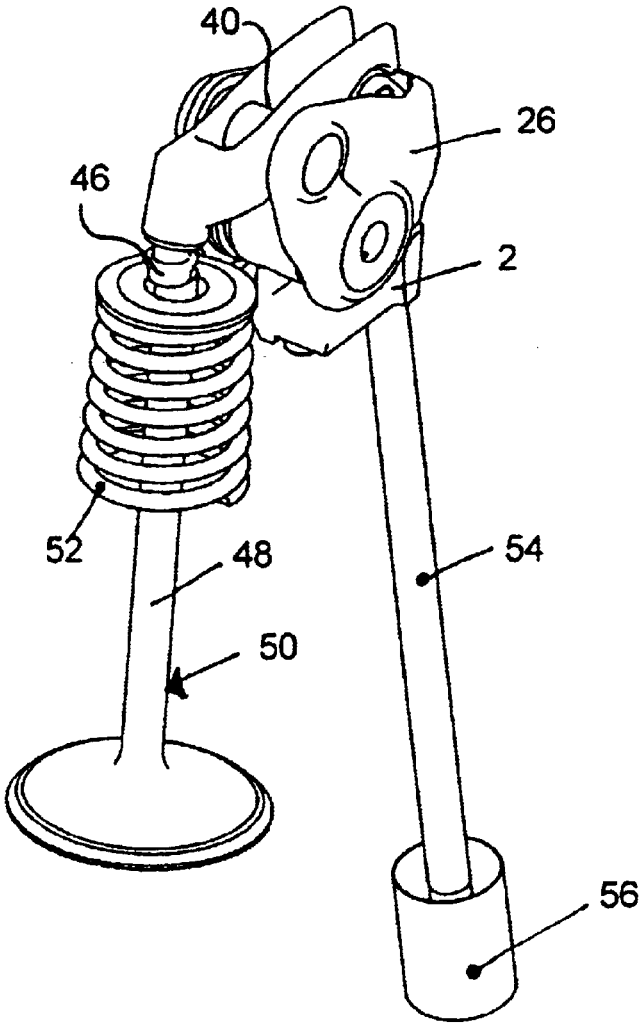
FIG. 2 is a perspective view of the components of FIG. 1 shown in the assembled state.

In the assembled state shown in FIG. 2, the pivot lever 8 is arranged to be actuated (pivoted) by a push rod 54 via an abutment surface formed on the bottom side of the projection 12. In a known manner, the push rod 54 optionally may be coupled a hydraulic play-compensation element 56, which will contact a rotating element (e.g., a camshaft or crank shaft) of the engine. Thus, the hydraulic play-compensation element 56 and the push rod 54 convert the rotating motion of the rotating element into a reciprocating linear movement that is applied to the abutment surface of the projection 12.

The push rod 54 may be substantially hollow and define a hydraulic fluid duct for supplying hydraulic fluid to actuate the locking piston 14, as well as to lubricate bearing surfaces and to supply pressure to the hydraulic valve play-compensating element 46. Ring grooves or channels may be defined in the bearing pin 6 and the bearing pin 32 for supplying hydraulic fluid. For example, hydraulic fluid may be led via the hydraulic fluid ducts into the corresponding channels of the pivot lever 8, the intermediate lever 26 and the valve lever 40.

A representative method for operating the representative embodiment will now be described. First, when the locking piston 14 is pressurized by a high pressure oil, the locking pin 14 is actuated to as to outwardly project and extend into (engage) the locking hole 36. As a result, the pivot lever 8 will be locked with (rigidly coupled to) the intermediate lever 26 when the locking pin 14 extends into the locking hole 36. In other words, by inserting the pin 14 into the locking hole 36, the pivot lever 8 and the intermediate lever 26 will move (pivot) together.

In the inactive (zero stroke) state of the push rod 54 (e.g., the push rod 54 is contacting a base portion of a cam, such that the valve is in the valve closed position), the valve lever 40 is biased in a clockwise direction by the valve play-compensating element 46. The components are dimensioned such that, when the intermediate lever 26 is rigidly or fixedly coupled to the pivot lever 8 due to the locking pin 14 being inserted into the locking hole 36, the bottom side of the crosspiece 34 is urged or biased so as to abut a stop 58. The stop 58 is formed so as not to move relative to the engine (i.e., the stop 58 is a stationary fixture within the engine compartment). For example, the stop 58 optionally may be formed as a part of the mounting base 2.

Due to the upward urging force supplied by the play-compensation element 56, the push rod 54 abuts against the bottom side of the projection 12 of the pivot lever 8. The forces of the play-compensation elements 56 and 46 are harmonised in such a manner that the compensation element 56 does not over-push the compensation element 46. The above-described condition (i.e., the zero stroke condition) is illustrated on the left hand side illustration of FIG. 4.

When the push rod 54 is moved upwards due to rotation of the camshaft (not illustrated), the pivot lever 8, which is locked together with the intermediate lever 26, pivots counter-clockwise. As a result, the valve lever 40 fully joins in this pivoting movement, because the abutment surface 21 of the pivot lever 8 drivingly contacts the abutment surface 44 of the valve lever 40. Therefore, during each full stroke, the push rod 54 will reach the upper maximum position H1, as shown in the middle illustration of FIG. 4.

Figure 3:
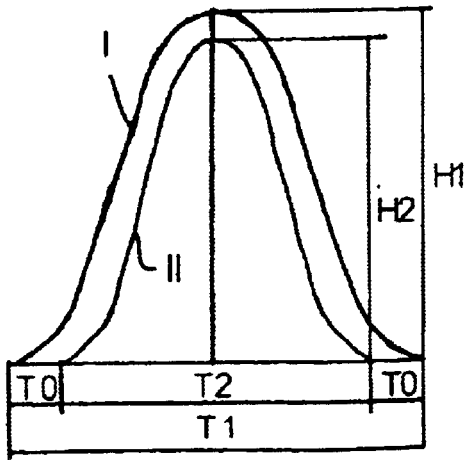
FIG. 3 shows two different valve stroke functions (I and II) that can be realized with the representative embodiment of FIGS. 1 and 2.

FIG. 3 shows two relationships (stroke functions) of valve opening distance (vertical axis) versus time (horizontal axis). Thus, when the locking pin 14 is inserted through the locking hole 36, thereby locking the pivot lever 8 with the intermediate lever 26, the valve 50 is actuated during each full stroke cycle (i.e., one cycle of valve opening and closing) according to the stroke function shown as stroke curve (function) I in FIG. 3. In other words, the valve 50 will be actuated so as to reach a maximum valve opening distance (stroke) of H1 and the valve 50 will have an opening duration of T1 (i.e., the valve 50 will be open for a time period identified as T1).

When the hydraulic fluid pressurisation of the locking piston 14 is reduced below a threshold level during the zero stroke condition, the biasing force of the spring 18 will exceed the pressure acting on the locking piston 14. As a result, the locking piston 14 will be withdrawn (retracted) from the locking hole 36, thereby unlocking the pivot lever 8 from the intermediate lever 26. In this case, the pivot lever 8 will be pivotable relative to the intermediate lever 26. In other words, the rigid connection between the pivot lever 8 and the intermediate lever 26 is released when the locking pin 14 is withdrawn from the locking hole 36.

However, the bottom side of the crosspiece 34 will continue to abut against the stop 58 in the zero stroke condition. The biasing force supplied by the leg springs 24 ensures that the pivot lever 8 remains abutted against the stop 47 of the intermediate lever 26 and the bottom side of the projection 12 remains abutted against the push rod 54. As was noted above, the leg springs 24 bias the pivot lever 8 in the clockwise direction relative to the intermediate lever 26.

When the push rod 54 is moved upwards while the valve actuating assembly is in the above-described unlocked condition, the pivot lever 8 pivots counter-clockwise, thereby separating from the stop 47. The pivot lever 8 further moves into the intermediate lever 26, which remains abutting against the stop 58 due to the pressure exerted on the valve lever 40. When the pivot lever 8 pivots relative to the intermediate lever 26, the abutment element 21 moves or rolls along the abutment surface 44 of the valve lever, as shown in the right hand illustration of FIG. 4. Thus, the pivot lever 8 pivots relative to the intermediate lever 26 while the valve 50 is being actuated.

The abutment surface 44 has a shape that defines the movement/time portions $T_0$ and $T_2$ shown in FIG. 3. In the representative embodiment, the abutment surface 44 is formed such that, while the pivot lever 8 is pivotable (unlocked) relative to the intermediate lever 26, the valve lever 40 does not move (pivot) relative to the intermediate lever 26. In addition, the abutment surface 44 is formed with suitable pivot radii so that the valve 50 will be actuated (opened and closed) according to the stroke curve (function) II shown in FIG. 3.

Stroke curve (function) II differs from stroke curve (function) I in that the maximum valve opening distance (stroke) H2 is smaller than H1 and the valve opening duration T2 is shorter than T1. In the representative embodiment, stroke curve II is symmetrical to stroke curve I. In other words, the timing of the maximum valve opening (H1 and H2) is identical. However, initiation of the valve opening is delayed in stroke curve II versus curve I by the time period T0. Similarly, when the valve 50 is actuated according to stroke curve II, the valve 50 will be closed earlier by the time interval T0 versus when the valve 50 is actuated according to curve I. The right-hand illustration of FIG. 4 shows the relative arrangement of the components when the intermediate lever 26 is unlocked and the maximum stroke is H2.

Naturally, the stroke function can be changed to suit particular design requirements by modifying the kinematic design of the levers and the abutment surface, which modifications are well within the capabilities of a skilled person in the art without further explanation being required.

The present teachings can be modified in numerous ways other ways, as well. For example, the locking device disposed within the projection 12 of the pivot lever 8 can include a piston with a shaft, in which the shaft forms the locking element. The retaining spring may be supported between a lid screwed into the projection, through which the shaft extends, and a step may be formed between the shaft and the piston.

Further, the locking device can be modified so as to be effective between the valve lever 40 and the intermediate lever 26. In other words, instead of locking the pivot lever 8 with the intermediate lever 26, the valve lever 40 may be locked with the intermediate lever 26 in order to achieve the same effects as the representative embodiment.

In another modification, the bearing pin 6 can be common to a plurality of or all the valves of the internal combustion engine. In other words, the bearing pin 6 may extend through two or more pivot levers and intermediate levers. In addition or in the alternative, the bearing pin 6 can also be fixedly coupled to the engine compartment or the engine block by means other than by being mounted on the bolt 4 that is screwed into the mounting base 2. Various connection means are possible and the present teachings are not particularly limited in this regard.

In another modification, the hydraulic fluid is not required to be supplied via the push rod 54. For example, the hydraulic fluid may be directly supplied via a bore hole defined in the bearing pin 6.

In another modification, the legs springs 24 can be replaced by other types of spring elements or biasing devices that provide the same or similar biasing effect. Further, the abutment element 21 can be formed as a cylinder element located within the pivot lever 8, or the abutment element 21 may defined purely as a gliding surface on the pivot lever 8.

When the locking pin 14 is withdrawn from the locking hole 36, the end face of the locking piston 14 will slide along the inner wall surface of the crosspiece 34 as the intermediate lever 26 pivots relative to the pivot lever 8. Therefore, this inner wall surface of the crosspiece 34 preferably has a contour that causes the locking piston 14 to axially move when the intermediate lever 26 is pivotable relative to the pivot lever 8. Such a design will prevent the rapid locking action from being hindered due to static friction between the locking piston 14 and the portion of the crosspiece wall that slidably contacts the locking piston 14.

The locking mechanism, which is disposed within the projection 12 of the pivot lever 8, alternately could be formed in such a way that high pressure oil leads to an unlocked state, while low pressure oil leads to a locked state.

The hydraulic fluid pressure for changing the locking or unlocking states may be controlled via an electric control mechanism in dependence upon the engine's operating conditions.

In another modification, another return spring may be provided to ensure that the intermediate lever 26 contacts stop 58 after each valve stroke.

Moreover, the present teachings are not limited to push rod operated engines, but also may be advantageously utilized with other types of engines that incorporate a component actuated (linearly reciprocated) by an arrangement of a camshaft and a pivot lever.

Furthermore, additional teachings relevant to, and advantageously combinable with the present teachings, are found in, e.g., commonly-owned U.S. Patent Publication Nos. 2002-124820, 2003-209216 and 2004-3789 and U.S. Pat. Nos. 5,908,015, 6,009,861, 6,131,545 and 6,186,101, the contents of which are hereby incorporated by reference as if fully set forth herein.

For ease of understanding the present description, a list of reference numbers utilized in the drawings is provided as follows:

2 mounting base
4 bolt
6 bearing pin
8 pivot lever
10 bearing portion
12 projection
14 locking piston
16 spring-holding pin
18 spring
20 holding pin
21 abutment element
22 through opening
24 leg spring
26 intermediate lever
28 bearing opening
30 through openings
32 bearing pin
34 crosspiece
36 locking hole
40 valve lever
42 bearing hole
44 abutment surface
46 valve play-compensating element
47 stop
48 valve stem
50 valve
52 locking spring
54 push rod
56 play-compensating element
58 stop

What is claimed is:

1. An apparatus capable of actuating a valve of an internal combustion engine according to a first stroke function and a second stroke function, which is different from the first stroke function, comprising:

a pivot lever mounted so as to be pivotable about an axis that is stationary relative to the engine, the pivot lever having an abutment element displaced from the axis, wherein the pivot lever is arranged and constructed to be pivoted about the axis by a reciprocating actuating device that is moved by a rotating element of the engine, an intermediate lever pivotably disposed on the pivot lever, a valve lever pivotably disposed with respect the intermediate lever, the valve lever being arranged and constructed to reciprocally move the valve according to the first stroke function or the second stroke function, wherein the valve lever comprises an abutment surface arranged and constructed to abut the abutment element, and a locking device arranged and constructed to be actuated so as to fixedly couple the intermediate lever to one of the pivot lever or the valve lever, wherein the apparatus is arranged and constructed such that:

(i) when the locking device is actuated to fixedly couple the intermediate lever to one of the pivot lever and the valve lever, pivotal movement of the pivot lever is transferred to the valve lever without the pivot lever pivoting relative to the valve lever, wherein the valve is actuated according to the first stroke function, and (ii) when the locking device is actuated to decouple the intermediate lever from one of the pivot lever and the valve lever, pivotal movement of the pivot lever is transferred to the valve lever by a combination of the pivot lever pivoting relative to the valve lever and the abutment element moving along the abutment surface, wherein the valve is actuated according to the second stroke function.

2. An apparatus according to claim 1, wherein the locking mechanism comprises a locking element arranged and constructed to engage the intermediate lever so as to fixedly couple the pivot lever with the intermediate lever and to disengage from the intermediate lever so as to permit the pivot lever to pivot relative to the intermediate lever.

3. Apparatus according to claim 1, wherein:

the intermediate lever is generally U-shaped with a pair of parallel arms connected by a crosspiece, wherein a locking bole is defined within the crosspiece and the pivot lever is accommodated within the parallel arms, and the locking element includes a projection that engages the locking hole in order to fixedly couple the pivot lever with the intermediate lever, and further comprising:

a spring disposed between the pivot lever and the intermediate lever, which spring biases the pivot lever, relative to the intermediate lever, towards the reciprocating actuation member.

4. An apparatus according to claim 3, wherein the valve lever is disposed between the parallel arms of the intermediate lever and is supported via a hydraulic valve play-compensating element on a valve stem of the valve.

5. An apparatus according to claim 1, wherein the abutment element comprises a roller that is adapted to roll along the abutment surface of the valve lever when the pivot lever is pivotable with respect to the intermediate lever.

6. An apparatus according to claim 1, wherein the second stroke function lies within the first stroke function.

7. An apparatus according to claim 1, wherein the locking device comprises a piston, which is movable into a hydraulic cylinder disposed in the pivot lever and the hydraulic cylinder is arranged and constructed to be pressurized with different hydraulic pressures so as to lock and unlock the pivoting movement of the intermediate lever.

8. An apparatus according to claim 7, further comprising hydraulic fluid supply ducts for supplying lubrication of bearing surfaces and to the hydraulic valve play-compensating element.

9. An apparatus according to claim 1, wherein the reciprocating actuating element comprises a push rod that is linearly movable by contacting a rotating camshaft or crankshaft of the engine.

10. An apparatus according to claim 9, wherein the push rod comprises a hydraulic fluid supply duct.

11. An apparatus according to claim 1, further comprising a bearing pin defining the axis that is stationary relative to the pivot lever, wherein the bearing pin extends through and supports the pivot lever and the intermediate lever is supported on the outside of the pivot lever.

12. An apparatus according to claim 1, wherein the second stroke function defines a valve opening distance and a valve opening duration that are less than a valve opening distance and a valve opening duration of the first stroke function.

13. An apparatus according to claim 1, wherein:

the intermediate lever is generally U-shaped with a pair of parallel arms connected by a crosspiece and is supported on the outside of the pivot lever, wherein a locking hole is defined within the crosspiece and the pivot lever is accommodated within the parallel arms, and the locking device comprises a piston that is movable upon application of a hydraulic pressure thereto so as to engage the locking hole and thereby fixedly couple the pivot lever to the intermediate lever, the valve lever is disposed between the parallel arms of the intermediate lever and is supported via a hydraulic valve play-compensating element on a valve stem of the valve, the abutment element comprises a roller that is adapted to roll along the abutment surface of the valve lever when the pivot lever is pivotable with respect to the intermediate lever, the reciprocating actuating element comprises a push rod that is linearly movable by contacting a rotating camshaft or crankshaft of the engine, and further comprising a bearing pin defining the axis that is stationary relative to the pivot lever, wherein the bearing pin extends through and supports the pivot lever and the intermediate lever is supported on the outside of the pivot lever, and a spring disposed between the pivot lever and the intermediate lever, which spring biases the pivot lever, relative to the intermediate lever, towards the push rod.

14. An apparatus according to claim 13, wherein the second stroke function defines a valve opening distance and a valve opening duration that are less than a valve opening distance and a valve opening duration of the first stroke function.

15. A method for actuating a valve of an internal combustion engine, wherein the valve is arranged and constructed to control the flow of a fluid into and out of a combustion cylinder, the method comprising:

locking an intermediate lever of a valve actuating device to one of a pivot lever and a valve lever of the valve actuating device, reciprocally pivoting the pivot lever, the intermediate lever and the valve lever about a pivotal axis, wherein pivotal movement of the pivot lever is transferred to the valve lever without the pivot lever pivoting relative to the valve lever and the valve is actuated according to a first stroke function, releasing the intermediate lever from said one of the pivot lever and the valve lever, and reciprocally pivoting the pivot lever, the intermediate lever and the valve lever about the pivotal axis, wherein pivotal movement of the pivot lever is transferred to the valve lever by a combination of the pivot lever pivoting relative to the valve lever and an abutment element of the pivot lever moving along an abutment surface of the valve lever and the valve is actuated according to a second stroke function, the second stroke function having a shorter valve opening duration than the first stroke function and the second stroke function having a smaller maximum stroke that the first stroke function.

16. An apparatus for actuating a valve of an internal combustion engine, wherein the valve is arranged and constructed to control the flow of a fluid into and out of a combustion cylinder, the apparatus comprising:

an intermediate lever, a pivot lever and a valve lever, means for selectively locking the intermediate lever to one of the pivot lever and the valve lever, such that when the intermediate lever is locked to said one of the pivot lever and the valve lever, pivotal movement of the pivot lever is transferred to the valve lever without the pivot lever pivoting relative to the valve lever and the valve is actuatable according to a first stroke function, and such that when the intermediate lever is unlocked from said one of the pivot lever and the valve lever, pivotal movement of the pivot lever is transferred to the valve lever by a combination of the pivot lever pivoting relative to the valve lever and an abutment element of the pivot lever moving along an abutment surface of the valve lever and the valve is actuatable according to a second stroke function, and means for reciprocally pivoting the pivot lever, the intermediate lever and the valve lever about a pivotal axis, wherein the second stroke function has a shorter valve opening duration than the first stroke function and the second stroke function has a smaller maximum stroke than the first stroke function.

* * * * *